United States Patent [19]

Newling

[11] Patent Number: 4,589,796

[45] Date of Patent: May 20, 1986

[54] GLASS FIBER SUCKER ROD SYSTEM

[75] Inventor: Robert P. Newling, Jackson, Mich.

[73] Assignee: Plastigage Corporation, Jackson, Mich.

[21] Appl. No.: 709,764

[22] Filed: Mar. 8, 1985

Related U.S. Application Data

[62] Division of Ser. No. 476,784, Mar. 18, 1983.

[51] Int. Cl.[4] ..... B25G 3/34; F16B 11/00

[52] U.S. Cl. ..... 403/266; 403/374

[58] Field of Search ..... 403/268, 267, 266, 374

[56] References Cited

U.S. PATENT DOCUMENTS

| | | | |
|---|---|---|---|
| 3,129,282 | 4/1964 | Flynn | 174/177 |
| 3,226,805 | 1/1966 | Scott et al. | 29/155.52 |
| 3,889,579 | 6/1975 | Wiechowski et al. | 92/3 |
| 4,024,913 | 5/1977 | Grable | 166/72 |
| 4,205,926 | 6/1980 | Carlson | 403/266 |
| 4,360,288 | 11/1982 | Rutledge, Jr. et al. | 403/268 |
| 4,494,890 | 1/1955 | Lusk | 403/374 X |

*Primary Examiner*—Andrew V. Kundrat

*Attorney, Agent, or Firm*—Beaman & Beaman

[57] ABSTRACT

The invention pertains to a system for handling pump or sucker rod for oil wells wherein the sucker rod is formed of a continuous length of glass fiber rod, i.e. glass filaments embedded within a resin. The rod is stored upon a reel and is dispensed therefrom when inserting the rod into a well, or is wound upon the reel when removing the rod. In embodiments of the system, the reel is power operated, or the rod may be directly engaged and driven adjacent the well. The rod is supported at transition locations to prevent stresses which would tend to delaminate the filaments, and fittings are disclosed for mounting upon the rod, or retrieving broken rod.

2 Claims, 10 Drawing Figures

GLASS FIBER SUCKER ROD SYSTEM

This application is a division of Application Ser. No. 476,784 filed Mar. 18, 1983.

BACKGROUND OF THE INVENTION

Reciprocating pumps utilized with oil wells are usually operated through a sucker rod system wherein a plurality of elongated steel rods are interconnected by threaded fittings, the lower end of the sucker rod string being attached to the pump piston, while the upper rod end is affixed to an oscillating pump arm. Sucker rods consisting of a plurality of interconnected metal rods are heavy, requiring relatively high energy to lift, are troublesome to install and remove as adjacent rods must be interconnected or disassembled as the rod system is inserted or removed, and the frictional coefficient of friction of conventional sucker rod systems is relatively high due to the presence of the fittings.

It has been proposed to replace the conventional multi-segment pumping or sucker rod systems with a single rod which extends the depth of the well. Single strand sucker rod systems utilizing metal rods are known wherein the rod is stored upon a reel. Also, a pumping rod system utilizing a single glass fiber rod is known as shown in U.S. Pat. No. 3,889,579.

Single strand sucker rod systems have not been utilized to an appreciable extent even though the same have definite advantages over multi-strand rod systems with respect to cost of manufacture, cost of installation and removal, and low frictional and weight characteristics. Such rod systems have not been widely accepted primarily due to the difficulty in handling and installing the rod, and removing the rod from the well. The glass fiber sucker rod disclosed in U.S. Pat. No. 3,889,579 has not been commercially feasible due to the inability of efficiently handling the rod and inserting and removing the rod with respect to the well.

It is an object of the invention to provide a sucker rod system for oil wells utilizing a continuous glass fiber rod wherein the rod is efficiently handled, stored and transported in such a manner as to protect the rod against damage, and yet permit ready dispensing and retrieval.

A further object of the invention is to provide a sucker rod system for oil wells utilizing a glass fiber rod wherein the rod is stored upon a reel and is readily dispensed from or rewound thereon.

Yet another object of the invention is to provide a sucker rod system for oil wells utilizing a glass fiber sucker rod wherein the rod is stored and transported on a reel having a substantially horizontal axis and power means are utilized to draw the rod from the well and store the rod on a reel.

Yet another object of the invention is to provide a sucker rod system for oil wells utilizing glass fiber rod wherein the rod is stored and transported on a reel having a substantially horizontal axis and rod support means are employed at transition zones as the rod changes between horizontal and vertical orientation between stored and use conditions.

An additional object of the invention is to provide a sucker rod system for oil wells utilizing a glass fiber rod which employs an endless friction traction drive apparatus for installing and removing the rod from a well.

Another object of the invention is to provide a fitting for use with glass fiber sucker rods wherein the fitting is capable of exerting high tension forces upon the rod without failure to the rod or fitting.

An additional object of the invention is to provide a sucker rods retrieval tool for use with glass fiber rods permitting broken rod to be readily removed from a well.

In the practice of the invention, the pump or sucker rod for an oil well is coiled upon a large reel and dispensed therefrom, or wound thereon when not located within a well. Preferably, the rod for a well consists of a single length of glass fiber rod formed of a plurality of elongated glass filaments embedded within a resin. In one embodiment of the invention the reel is power operated, while in another embodiment a drive mechanism directly associated with the rod provides the force for uncoiling or coiling the rod upon the reel.

The reel has a substantially horizontal axial orientation, and the rod is dispensed from the reel in a substantially horizontal manner. At the transition zone wherein the rod passes from a horizontal orientation to a vertical relationship at the well, support means are provided to prevent the rod from being bent to an extent which might cause fracturing of the rod or separation of the filaments within the resin.

The system of the invention also includes a fitting attached to the ends of the rod to which the usual pumping apparatus may be connected through threaded components, and the fitting is of such nature that interconnection between the fiting and rod increases proportional to the tension forces being transmitted.

Additionally, the system includes a retrieval tool for "fishing" broken glass fiber rod from a well, and the retrieval tool automatically grips the rod upon a lifting or tension force being applied.

DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 9:
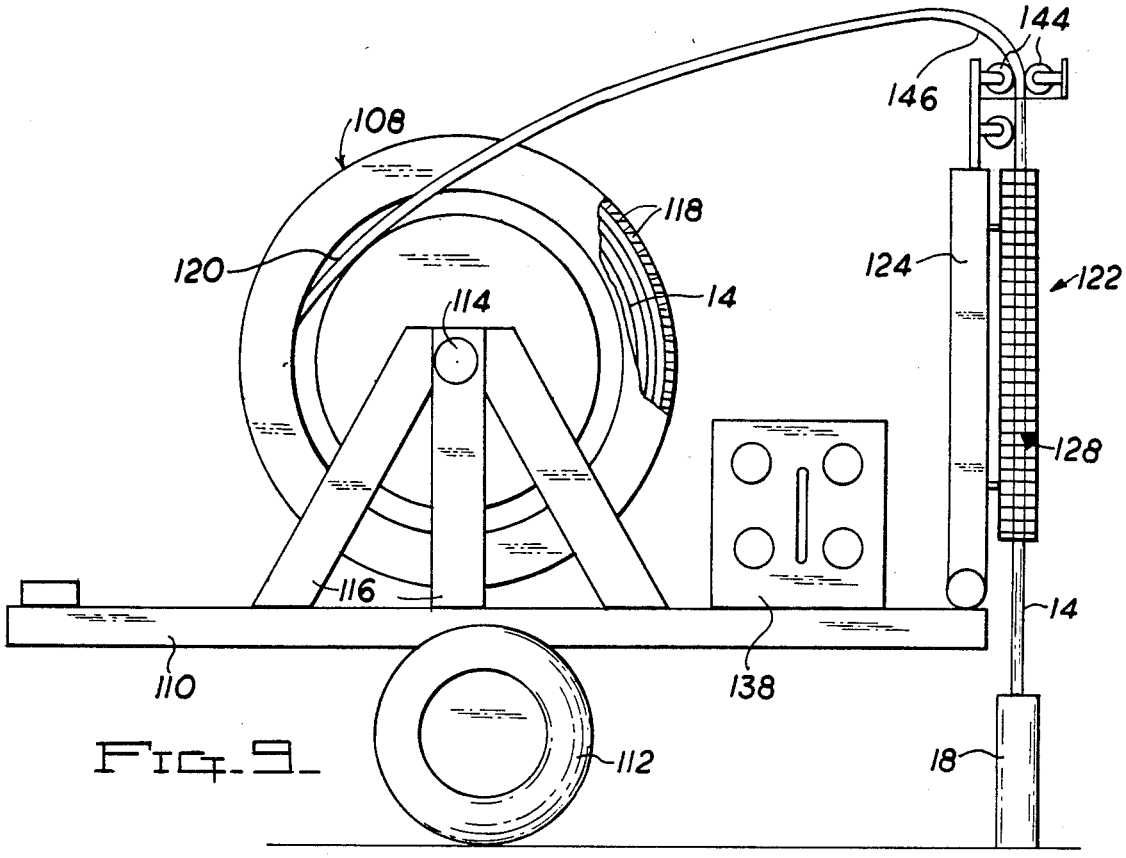
FIG. 9 is an elevational view of another embodiment of rod reel and rod drive apparatus.
Figure 10:
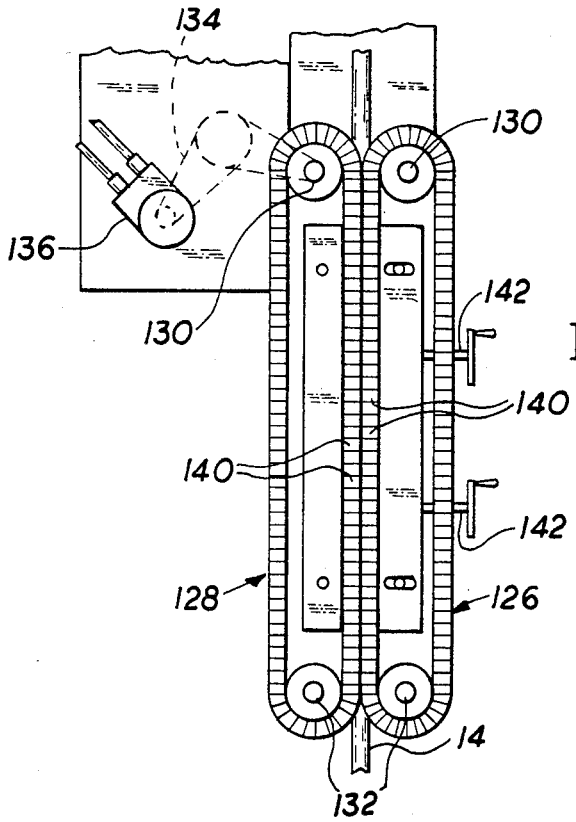
FIG. 10 is an elevational view of the apparatus of FIG. 9 as taken from the right thereof.

The apparatus illustrated in FIGS. 1–4 pertains to an embodiment wherein the glass fiber sucker rod is stored and transported on a power driven reel. In the embodiment of FIGS. 9 and 10 the rod reel is not powered, and tension forces within the rod are controlled by a rod engaging drive apparatus.

With respect to the embodiment of FIGS. 1–4, the sucker rod system includes a vehicle, such as a trailer 10, which supports a large spool or reel 12 upon which the glass fiber rod 14 has been wound. The reel 12 of known manufacture may be rotated under power in either direction by motor apparatus 16, such as produced by Hogg & Davis Inc. of Long Beach, Calif., as such apparatus is similar to that used in installing electrical transmission lines, sewer maintenance, and the like. The trailer 10 is readily towed by a truck or tractor, and may be positioned as desired relative to the vertically oriented oil well 18 in which the sucker rod is installed.

Figure 1:
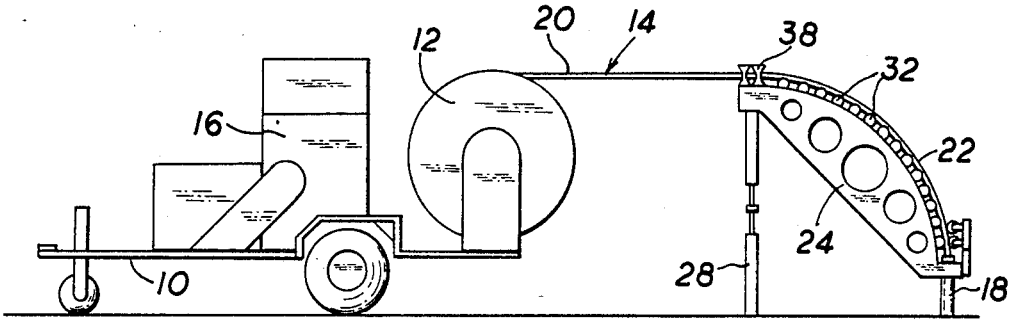
FIG. 1 is an elevational view of one embodiment of the invention utilizing a power driven reel.
Figure 2:
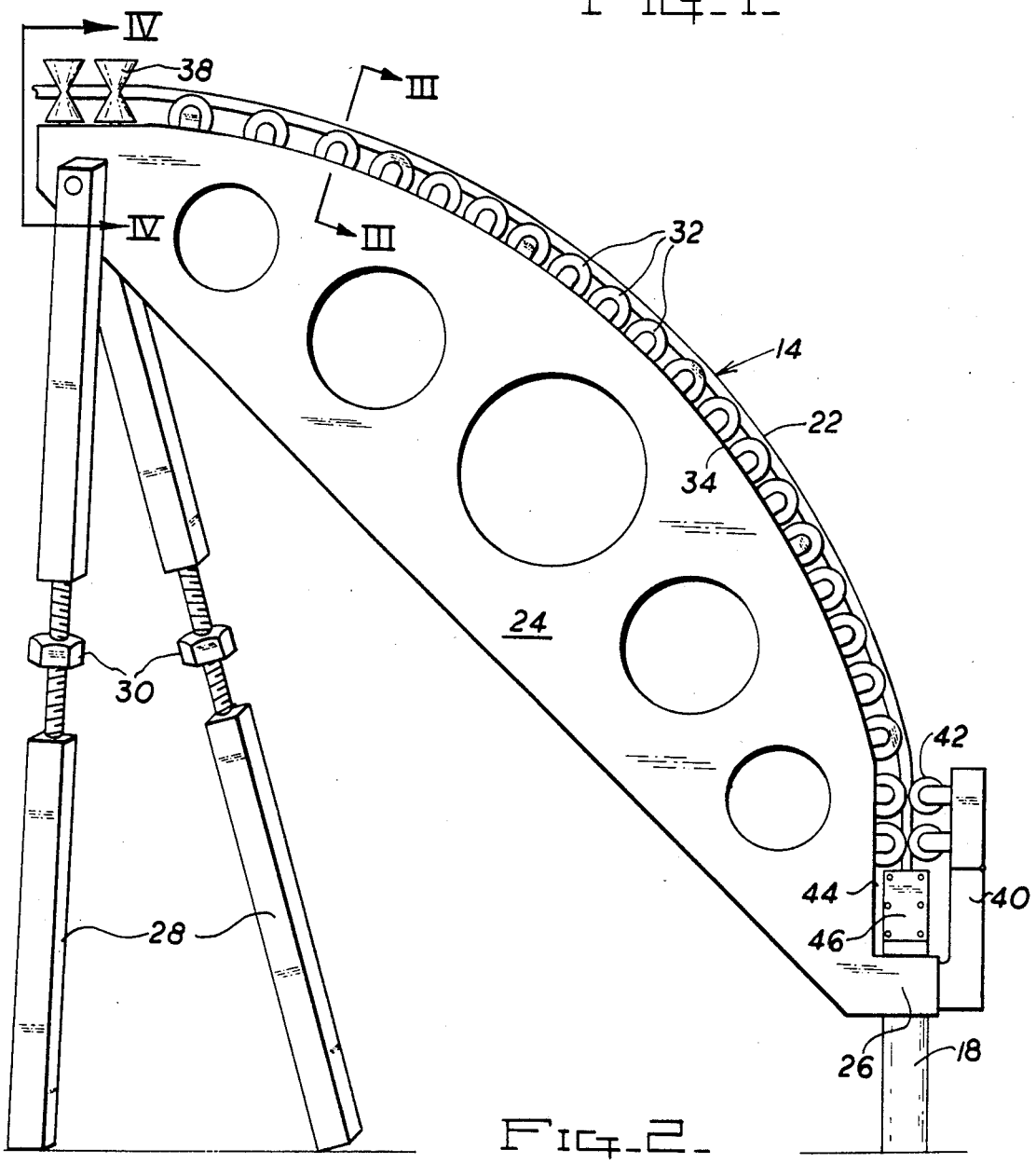
FIG. 2 is an enlarged, elevational, detail view of the rod transition support shown in FIG. 1.

The axis of rotation of the reel 12 is horizontal, and as appreciated in FIG. 1, the rod portion 20 adjacent the reel is substantially horizontally disposed. As the well 18 is vertically oriented the rod must pass through a transition zone 22 consisting of a 90° bend in passing from the reel to the well, and vice versa. This transition zone of the rod is supported by the bracket 24. The bracket 24, at its lower end, is removably attached to the upper end of the well 18 by clamp 26. At its upper end, the bracket is supported by adjustable columns 28, constituting a bipod, each of which is adjustable by a turnbolt 30 having threaded stems of opposite hand wherein rotation of the bolts will increase or lengthen the length of the bipod columns.

Figure 3:
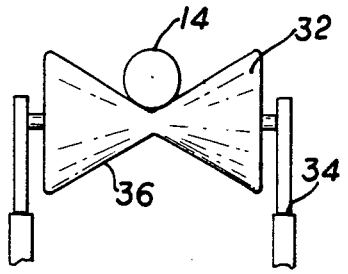
FIG. 3 is an enlarged, elevational, sectional view as taken along Section III—III of FIG. 2.
Figure 4:
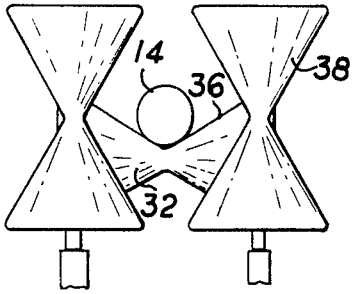
FIG. 4 is an elevational sectional view taken along Section IV—IV of FIG. 2.
Figure 5:
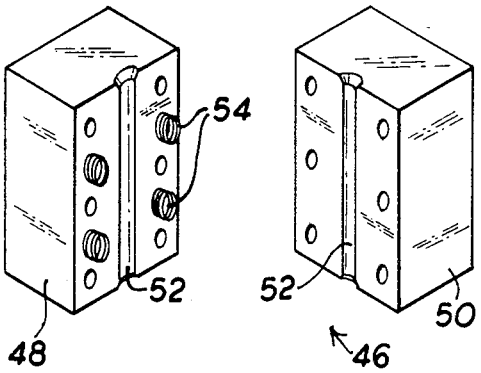
FIG. 5 is a perspective view of a clamping block utilized with the embodiment of FIGS. 1 and 2.

A plurality of rollers 32 are rotatably supported upon convex surface 34 of the bracket 24, each roller having a "V" configuration 36, FIG. 3, and the rollers define a convex supporting surface for the rod 14 as it passes through the transition zone 22 which is of a convex configuration. The radius of the convex support defined by the rollers 32 is great enough to prevent such a sharp bend in the sucker rod, even when under tension, as would cause the rod filaments to separate or "splinter" due to fracturing of the resin, which would occur if the radius at the transition zone 22 is too "sharp".

At its uppermost end, guide rollers 38 rotating about vertical axes align with the rollers 32 to maintain alignment of the sucker rod upon the rollers 32 even during lateral misalignment of the rod as the rod unwinds across the width of the reel 12.

At its lower end, the bracket 24 includes a vertically extending column 40 upon which rollers 42 are mounted in opposition to rollers 32, and being of a like configuration, wherein the rod is supported on both sides as it enters the upper end of the well 18.

A clearance exists between the lowermost roller 32 and the upper end of the well as represented at 44 wherein a pinch block 46 may be located therein and rest upon the top of the well to clamp the rod and prevent loss of the rod when the rod is severed from the reel 12 and provided with a fitting. The pinch block consists of two rectangular portions 48 and 50 each of which includes a semi-cylindrical recess 52, and the block portions may be interconnected and drawn together by bolts and biased apart by springs 54. Thus, the rod 14 is received within the completed bore defined by recesses 52 and tightening of the bolts will frictionally grasp the rod and support its weight.

Prior to the rod being inserted into the well 18 pump structure, not shown, is attached to the lower end of the rod, and the weight of the pump structure, as well as the weight of the rod itself, permits the rod 14 to be drawn into the well under gravitational forces. Thus, by controlling the rate of rotation of the reel 12, the rate at which the rod descends into the well can be closely controlled.

When it is desired to withdraw the sucker rod from the well, the upper end of the rod is attached to the reel 12, and the reel is wound in a counterclockwise direction, FIG. 1, winding the rod thereon. In this manner, the rod is drawn from the well, and the rollers 32 will prevent the rod, even though it is under high tension, from being bent at such a sharp radius as to damage the rod.

Figure 7:
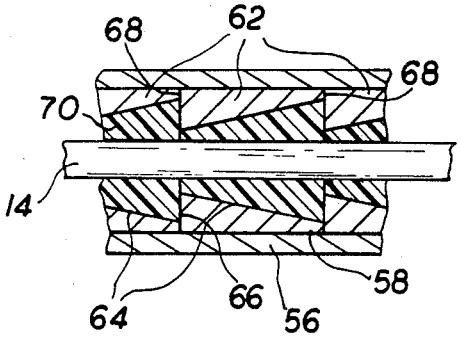
FIG. 7 is an enlarged, detail elevational view of the fitting casing, inserts, and rod of the fitting of FIG. 6.
Figure 6:
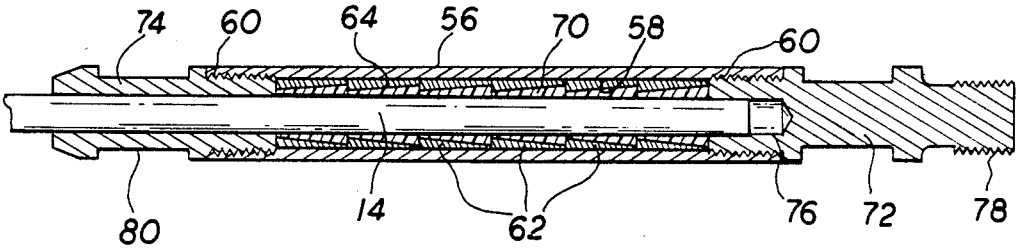
FIG. 6 is an elevational, diametrical, sectional view of a fitting utilized with the glass fiber rod of the invention.

FIGS. 6 and 7 illustrate a type of fitting which may be attached to the ends of the rod for affixing pump structure to the rod lower end, and the operating arm structure to the rod upper end. The fitting shown in FIG. 6 consists of a cylindrical casing 56 having a cylindrical bore 58. The bore 58 is threaded at 60 adjacent each end. A plurality of cylindrical inserts 62 are located within the casing and snugly fit within the bore 58, but are axially displaceable therein. Each insert includes a conical bore 64 which intersects the insert ends 66 and 68. The inserts are assembled such that the bores 64 converge in a common axial direction, as will be apparent from FIGS. 6 and 7.

The end of the glass fiber rod 14 is inserted into the casing 56 and the minimum diameter of the bores 64 is greater than the diameter of the rod as will be noted from FIG. 7. The space between the rod and bores 64 is filled with a hardenable synthetic plastic resin 70 which bonds to the rod, but a mold release material is coated upon the insert bores 64 to prevent bonding of the resin to the inserts.

As noted from FIG. 6, an adapter 72 is threaded to the outer right end of the casing 56 on threads 60, while the adapter 74 is threaded to the casing left inner end. The adapter 72 includes an internal coaxial recess 76 which receives the end of the rod 14 and aids in aligning the rod within the insert bores. Threads 78 defined upon the insert 72 permit the associated pumping or operating components to be readily attached to the casing and rod.

The adapter 74 is of a tubular configuration wherein the rod 14 extends therethrough, and includes an external cylindrical recess 80 providing a gripping surface and shoulder, if needed.

Tension forces within the rod 14 tend to displace the rod to the left, FIG. 6, and such force tends to displace the resin 70 toward the left due to the resin being bonded to the rod. As the resin is not bonded to the associated insert bore 64, any axial displacement of the rod and resin that occurs relative to the inserts 62 will tend to radially constrict the resin tighter upon the rod increasing the frictional engagement between the rod and resin resulting in a fitting interconnection with the rod capable of transmitting very high tension forces without producing fracture or localized stresses upon the rod.

Figure 8:
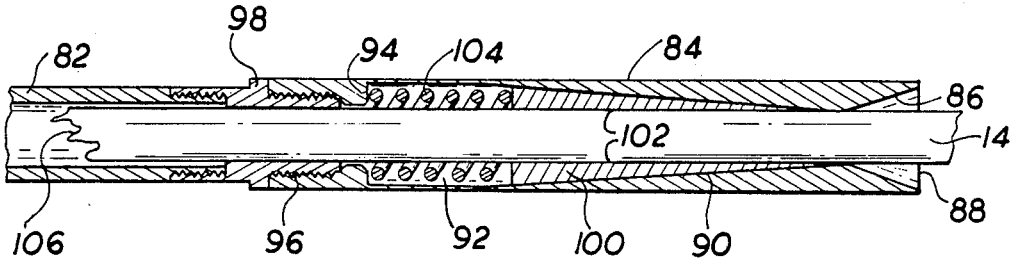
FIG. 8 is an elevational diametrical sectional view of a retrieval tool used with glass fiber rod in accord with the invention.

In the event that the glass fiber rod 14 should fracture while in the well and must be retrieved, the tool shown in FIG. 8 may be utilized. The tool of FIG. 8 is threaded upon a tubular shank 82, which is suspended from a retrieval cable, not shown, and the tool includes a cylindrical casing 84 which is of such dimension as to be received within the well tube. Internally, the casing 84 includes an alignment or entrance surface 86 of diverging conical configuration intersecting the forward or lower end 88 of the casing, and the conical cam surface 90 within the casing intersects the surface 86 converging toward the end 88. The casing includes a spring receiving portion 92 of cylindrical configuration, and a radial shoulder 94 is defined within the casing adjacent the internal threads 96 which receives the threaded adapter 98 to which the extension shank 82 is threaded.

Several conical segment jaws 100 are located within the casing 84 in radial alignment with the cam surface 90, and these jaws are each provided with a cylindrical segment bore portion 102, which together, define a cylindrical bore for receiving an end of the broken rod 14. A compression spring 104 is interposed between the shoulder 94 and the end of the jaws 100 which biases the jaws toward the right, FIG. 8, in a direction tending to contract the jaws segments 100 upon the rod 14.

When retrieving a fractured rod 14 using the tool in FIG. 8, the tool is attached to the extension shank 82 and lowered into the well. Upon the forward end of the tool reaching the upper fractured end 106 of the rod 14, the rod will align itself with the casing by surface 86 and enter the casing. The weight of the retrieval tool is sufficient to permit the frictional engagement between the rod and the jaws 100 to move the jaws toward the spring 104 compressing the spring and permitting the casing to ride down over the top of the rod, and depending on whether or not the rod end is splintered, only a small portion of the rod need enter the casing, or several feet may pass the jaws 100 for reception of the rod end 106 into the shank 82 as illustrated in FIG. 8. The shank 82 and casing 84 are then raised, and due to the biasing of the jaws 100 toward the cam surface 90, and due to the frictional engagement between the rod and the jaws, the jaws 100 engage the cam surface 90 and radially grip the rod permitting the tool to pull the rod from the well. The higher the tension forces required to raise the sucker rod, the greater will be the gripping action produced by the jaws 100.

In the sucker rod handling embodiment of FIG. 9, a reel 108 is mounted upon a trailer 110, which includes road wheels 112. The reel 108, as illustrated, is rotatably supported upon an axle 114 supported on braces 116, and is of the internally wound type wherein the rod is dispensed from the center of the coil, rather than the circumference, and the reel circumferentially includes a plurality of plate 118 defining the reel maximum circumference. The rod 14 is dispensed through the reel side opening 120 and is fed to the power unit 122.

The power unit 122 is mounted upon the rear of the trailer 110 and includes a frame 124 upon which a pair of endless conveyor track members 126 and 128 are mounted. The conveyors each include an upper power driven roller 130 and a lower roller 132, and the endless track apparatus is mounted upon each set of rollers. The upper rollers 130 are powered by a chain transmission 134 connected to a hydraulic motor 136, FIG. 10, and the motor receives pressurized hydraulic fluid from the trailer mounted hydraulic supply unit 138.

The conveyors 126 and 128 each include a plurality of pads 140 mounted upon a chain, and each block is provided with a cylindrical segment indentation wherein opposed pads located upon the conveyors define an aligned bore receiving the sucker rod located between the conveyors. The spacing between the conveyors 126 and 128 is controlled by threaded rods 142 rotated by cranks and the closer the conveyors are brought together, the greater the frictional contact with the sucker rod 14.

At its upper region, the power unit 122 includes a plurality of rollers 144 which maintain alignment of the rod 14 with the conveyors and as the rod is subjected to very little tension at the transition region 146 with this embodiment, damage to the rod does not occur even though a relatively sharp "bend" may occur.

In use, the rate of lowering of the sucker rod into the well is controlled by the rate of rotation of the motor 136, and movement of the conveyors, and likewise, the rate at which the sucker rod is drawn from the well will be determined by the speed of the motor and conveyors. The glass fiber rod, which may vary in diameter from ⅝" to 1", is stiff enough to rotate the reel 108 which "idles" regardless of whether the rod is being dispensed from the reel, or being wound thereon.

It will be appreciated that the apparatus of the invention invention constitutes a practical means for handling continuous sucker rod formed of glass fiber, and the disclosed apparatus permits the rod to be inserted and removed from an oil well under controlled conditions which will not damage the rod. It is appreciated that modifications to the inventive concept may be apparent to those skilled in the art without departing from the spirit and scope of the invention.

I claim:

1. A high tension end fitting for a glass fiber sucker rod comprising, in combination, a tubular casing having an inner cylindrical surface and ends, a plurality of inserts within said casing each having a continuous uninterrupted outer cylindrical surface of slightly less diameter than the diameter of said casing inner surface, first and second ends and a conical axial bore converging in the axial direction from said first end to said second end, the maximum diameter of said bore intersecting said first end and the minimum diameter of said bore intersecting said second end, the minimum diameter of said bore at said second end being greater than the rod diameter, said inserts being located in end-to-end relationship within said casing, said first end of one insert engaging said second end of the adjacent insert, said inserts defining a recess within said casing consisting of a plurality of conical segments, a glass fiber rod end received within said recess, a hardened resin within said recess and conical segments bonded to said rod, bond release means interposed between said inserts' bores and said resin preventing bonding of said resin to said inserts, said resin having an outer surface corresponding in configuration to the shape of said inserts' bores and axially displaceable relative to said inserts, said inserts' second ends being disposed in the axial direction of tension forces imposed on the glass fiber rod whereby rod tension forces tend to displace said rod end in the direction of said inserts' second ends causing said resin to be compressed upon said rod end by inserts' conincal bores, internal threads defined upon said casing at each end thereof, an adapter threaded upon each casing end defining rod connection means, said adapters each including an exteriorly threaded end engaging said casing's internal threads and an inner end engaging the end of the adjacent insert whereby said adapters axially position and retain said inserts within said casing.

2. In a high tension end fitting for a glass fiber rod as in claim 1, said adapter engaging the insert end intersected by a bore minimum diameter having a cylindrical axial bore therethrough closely receiving said rod end and said adapter inner end engaging the insert end intersected by a bore maximum diameter having a cylindrical concentric recess closely receiving the rod end whereby said adapters' bore and recess center said rod end within said casing recess.

* * * * *